United States Patent [19]

Detweiler

[11] 4,218,406

[45] Aug. 19, 1980

[54] AUTOMATIC CHOKE CONTROL

[75] Inventor: Charles A. Detweiler, Durand, Mich.

[73] Assignee: Schmelzer Corporation, Durand, Mich.

[21] Appl. No.: 37,639

[22] Filed: May 11, 1979

[51] Int. Cl.[2] ..... F02M 1/12

[52] U.S. Cl. ..... 261/39 B; 261/39 E; 126/400; 236/101 C

[58] Field of Search ..... 261/39 E, 39 B; 126/400; 236/99 D, DIG. 6, 101 C; 123/119 F

[56] References Cited

U.S. PATENT DOCUMENTS

| | | | |
|---|---|---|---|
| 3,092,999 | 6/1963 | Eickmann et al. | 261/39 B |
| 3,109,874 | 11/1963 | Mennesson | 261/39 B |
| 3,179,098 | 4/1965 | Highley et al. | 261/39 B |
| 3,463,140 | 8/1969 | Rollor, Jr. | 126/400 |
| 3,536,058 | 10/1970 | Hearst | 126/400 |
| 3,603,106 | 9/1971 | Ryan et al. | 126/400 |
| 3,972,311 | 11/1974 | DePetris | 261/39 E |
| 4,038,955 | 8/1977 | Paulmier | 261/39 E |
| 4,058,097 | 11/1977 | Silverstein et al. | 261/39 E |
| 4,083,336 | 4/1978 | Armstrong et al. | 261/39 E |
| 4,104,185 | 8/1978 | Schroder | 126/400 |

*Primary Examiner*—Tim R. Miles

*Attorney, Agent, or Firm*—Fisher, Gerhardt, Crampton & Groh

[57] ABSTRACT

A choke control device for delaying closing of a choke valve regulated by a temperature responsive bimetal coil after an internal combustion engine is turned off by employing a heat sink which stores the latent heat of fusion or vaporization that is delivered to the heat sink after the choke is open and the engine is operating at normal temperatures and which releases the latent heat after the engine has been turned off and cools to heat the bimetal coil and delay closing movement of the choke valve.

14 Claims, 4 Drawing Figures

AUTOMATIC CHOKE CONTROL

This invention relates to carburetors for internal combustion engines and more particularly to a choke control for such carburetors.

Automatic choke devices often employ a coiled bimetal member which is connected to the choke valve of a carburetor for an internal combustion engine and is adapted to urge the choke valve to a closed position with a force inversely proportional to ambient operating temperatures so that when an engine is cold, the choke is in a closed position and as the engine warms up the choke is moved toward an open position. With such arrangements difficulties are sometimes encountered when an engine is restarted a short time after it has been shut off as a result of a condition in which the bimetal temperature responsive coil cools at a greater rate than the engine block. Consequently, even though the engine is warm, the choke valve may have been moved to a closed position. This results in excessive fuel being fed to the carburetor causing excessive emission of pollutants and engine starting difficulties.

Efforts have been made to solve this problem by various electric controls in an effort to delay cooling of the bimetal elements so that the choke remains open for a longer period of time after an engine has been shut off but such arrangements frequently become complex and still are not capable of keeping the choke valve open for a sufficiently long time to facilitate easy starting of warm engines.

It is an object of the invention to provide means for delaying movement of a carburetor choke valve from its open to its closed position after an engine has been shut off.

Another object of the invention is to provide an arrangement for delaying the movement of the choke valve to its closed position after operation of an engine has been terminated by means not dependent on a source of electric power.

Yet another object of the invention is to provide an automatic choke control employing a heat sink capable of absorbing heat and storing it during engine operation so that the heat can be released after operation of the engine has been stopped to heat the bimetal temperature responsive device controlling the choke and delaying its closing.

The objects of the invention are accomplished by providing a choke control device for carburetors incorporating a bimetal coil element operative to hold a choke valve in a closed position when the temperature of the engine is low and moves the choke valve to an open position at some predetermined elevated temperature of the engine. Means are incorporated to heat the bimetal coil in proportion to engine and ambient temperature when the engine is operating. Heat also is supplied to a heat sink which includes a paraffin material which is melted after the choke valve opens and which solidifies after the engine is turned off to return the latent heat of fusion or vaporization to the bimetal coil thereby delaying closing movement of the choke valve.

A preferred embodiment of the invention is disclosed in the following description and in the drawings in which.

Figure 1:
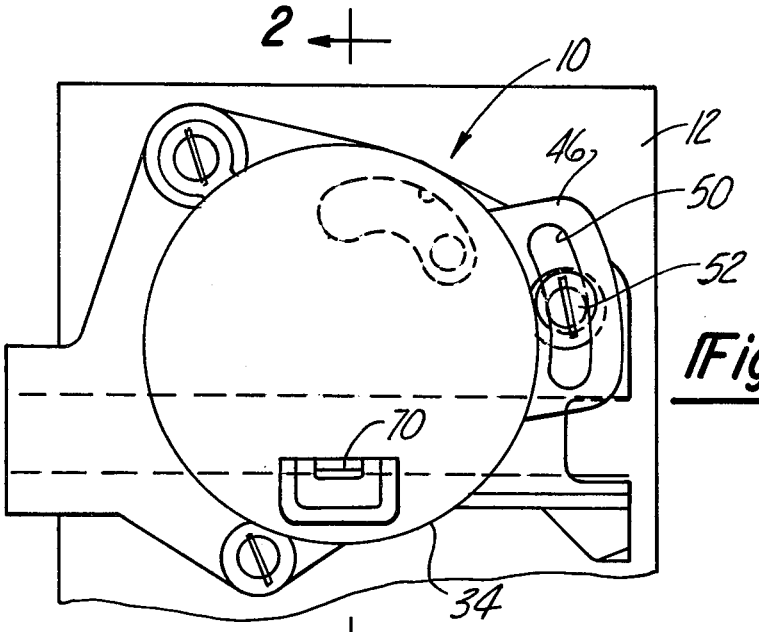
FIG. 1 is a plan view of the choke control device embodying the invention.

The automatic choke control device embodying the invention is designated generally at 10 and is mounted directly on the exterior of a carburetor 12 to control the operation of a choke valve or plate 14 mounted in an air induction passage 16 and supported on a shaft 18 for rotational movement between opened and closed positions.

The automatic choke 10 includes a temperature sensitive element in the form of a bimetal coil or element 20 having its radially inner end attached to a spindle 22. The radially outer end of the bimetal element 20 is connected by a loop 24 to an arm 26 forming part of a lever 28 fixed to the end of the shaft 18. The bimetal coil 20 is responsive to changes in temperature and tends to expand or contract to rotate the shaft 18 and to move the choke valve or plate 14 to various positions in proportion to temperature. In a cold condition such as that experienced when an engine is not operating, the coil 20 is contracted and tends to hold the choke plate 14 in its closed position illustrated in FIG. 2. As the coil 20 is heated, it tends to expand and to rotate the shaft 18 and therefore the attached choke plate 14 toward an open position illustrated in broken line in FIG. 2.

The bimetal coil 20 is disposed within a plastic housing 30 formed by a pair of cup-shaped members 32 and 34 which in the assembled condition of the automatic choke control 10 are permanently bonded together by sonic welding or adhesive. The cup-shaped members 32 and 34 form a slot 36 in the interior of the housing 30 which receives a metal plate 38 dividing the housing 30 into cavities 40 and 42. The plate 38 supports the spindle 22 and is supported in the slot 36 for limited rotational movement about the axis of the spindle by way of arm 46 formed integrally with the plate 38 and projecting from the interior of the housing 30 through a slot 48 which is formed between the cup-shaped members 32 and 34.

An arcuate slot 50 is formed in the arm 46 to receive a screw 52 having a length sufficiently long to be threadably engaged in a wall of the carburetor 12. The screw 52 acts to clamp the arm 46 to prevent rotation of the plate 38. The plate 38 can be rotated a limited about about the axis of the spindle 22 making it possible to adjust the position of the bimetal coil 20 to determine the amount of force urging the choke plate 14 toward a closed position which also serves to determine the temperature at which the choke plate 14 beings to move from a closed position toward an open position.

Metal plate 38 supports heating means in the form of a positive temperature coefficient thermistor or PTC resistor 54 in the form of a disc which is fastened to the plate 38 in electrically and thermally conductive relationship.

Figure 2:
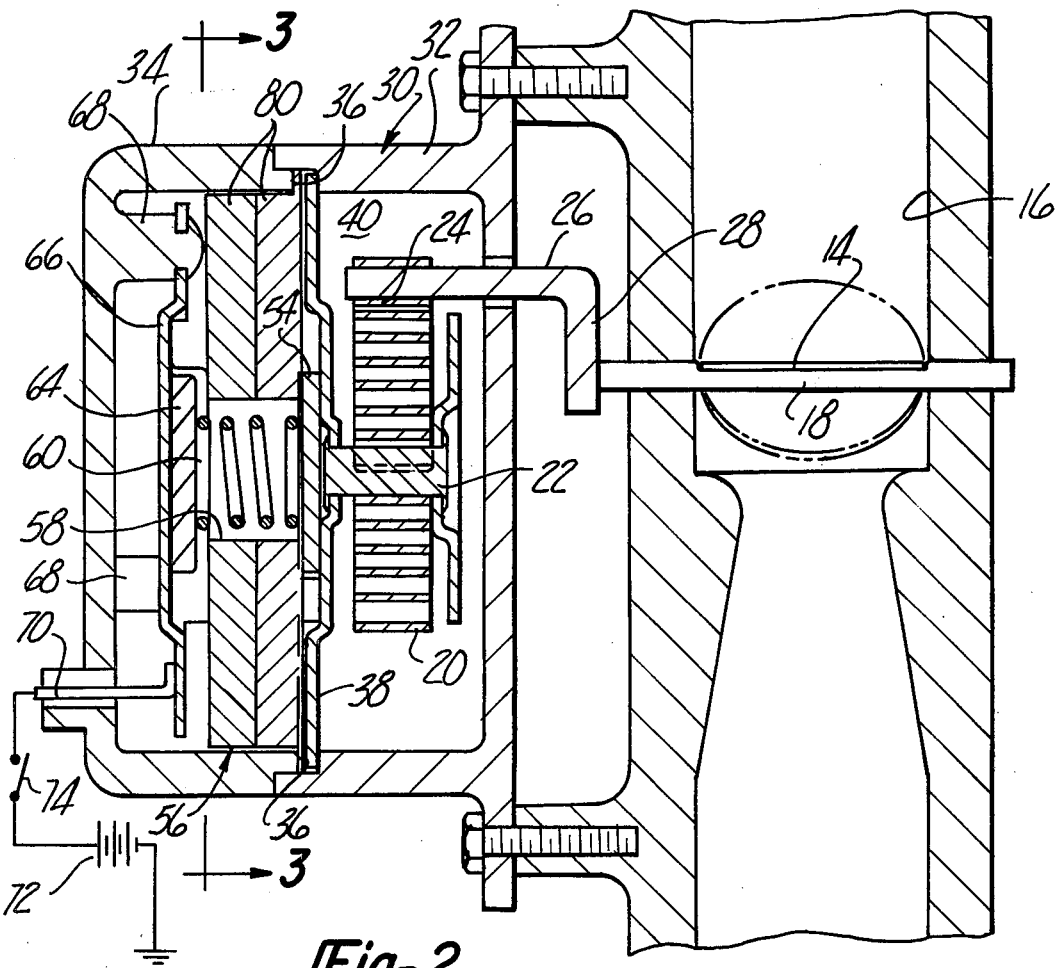
FIG. 2 is a cross-sectional view taken on line 22 in FIG. 1.
Figure 3:
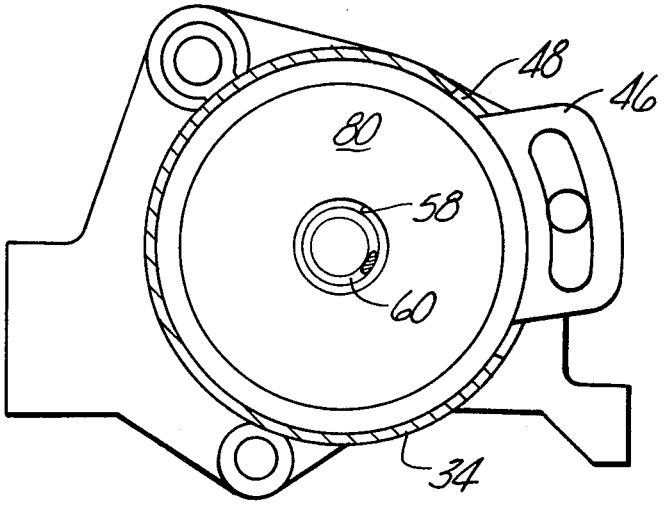
FIG. 3 is a cross-sectional view taken on line 33 in FIG. 2.

Disposed in the cavity 42 to one side of the plate 38 is an annular heat sink 56 having a central opening 58 which acts to position an electrically conductive spring 60. One end of the spring 60 is in engagement with the PTC unit 54 and the opposite end abuts a negative temperature coefficient thermistor or NTC resistor element 64. The NTC element 64 is fixed in electrically conductive relationship on a metal plate 66 held in position within the cavity 42 on plastic posts 68 formed integrally with the cup-shaped member 34 as seen in FIG. 2. The electrically conductive plate 66 is provided with an electrical terminal 70 exposed at the exterior of the housing and adapted to be connected to a source of power such as a vehicle battery indicated diagrammatically at 72. A complete electrical circuit is formed from the battery 72 through a switch 74 such as the ignition switch on a vehicle and through the terminal 70 to the metal plate 66 and to the NTC element 64, through spring 60 to the PTC element 54, plate 38, arm 46 and screw 52 to ground at the carburetor housing. If preferred, the terminal 70 can be placed in circuit with an alternator associated with an internal combustion engine so that current is supplied only when the engine is operating.

When an internal combustion engine is cold and has not been started, the bimetal coil 20 acts to hold the choke plate 14 in closed position. When the engine is started a small current flows from battery 72 through the NTC element 64, spring 60 and the PTC element 64 presents a relatively high resistance to current flow in its resistance and an increase in current flow to the PTC element 54 which acts as a heater and transmits heat to the plate 38 and directly through spindle 22 to the bimetal coil 20. As the bimetal coil 20 increases in temperature it uncoils and moves the choke plate 14 toward an open position until the choke 14 is fully open when the engine reaches some predetermined operating temperature such 150° F., for example.

When operation of the engine is terminated, the engine begins to cool. Similarly, the associated part such as the carburetor and the automatic choke 10 also drop in temperature. However, the automatic choke 10 usually drops at a faster rate than the engine block and at a predetermined temperature level of the automatic choke, for example 150°, the bimetal coil 20 begins to contract and to move the choke plate 14 towards a closed position even though the engine may be at a sufficiently high temperature to warrant an open valve.

It is highly desirable to delay the rate of cooling of the bimetal coil 20 to avoid problems that can occur when an attempt is made to start a warm engine but the bimetal coil 20 has cooled sufficiently to move the choke to a partially or fully closed position. Closing of the choke plate 14 is delayed through means of the heat sink 56.

The head sink 56 is made up of a pair of annular pads 80 disposed in the cavity 42 of the cup-shaped housing member 34 and disposed between the plates 38 and plate 66. The pads 80 are made of a porous material such as felt and are impregnated with a paraffin material. Although two pads 80 are shown it should be understood that a single such pad to occupy the space between the plates, could be used. Paraffin material can be compounded and obtained commercially which will melt at any of a variety of selected temperatures. In the present instance it is preferred to have a melting point at approximately 150° F. or some temperature occurring very soon after the choke plate has been moved to a fully open position. The paraffin material is retained in the felt pads 80 in its solid state and also in the liquid state much as fuel is retained in the wick of a lamp.

During warm-up of an engine, heat is supplied to the bimetal coil 20 to cause it to open the choke plate 14 and at the same time is being supplied to the plate 38 and heat sink 56 formed by the pads 80. As the engine reaches its normal operating temperature, for example 150° F., the choke plate 14 will have reached its fully open position and immediately thereafter the paraffin material contained within the pads 80 is melted and remains retained in the pad 80. The change in state of the paraffin from a solid to a liquid requires the addition of considerable heat without any change in temperature. The heat as well as the liquid paraffin are contained within the felt pads 80 during the time that the engine is being operated at its normal temperatures and the choke remains in its fully open position.

When the engine is turned off and begins to cool, the automatic choke 10 will begin to cool even faster and the paraffin will begin to solidify. The latent heat which was required initialy to melt the paraffin is released without a change of temperature and serves to heat the bimetal coil 20 which is thermally connected through metal plate 38 to the heat sink 56 to delay contraction and movement of the choke plate 14 towards its closed position.

Although the latent heat of fusion, that is the heat required to change the paraffin from a solid to a liquid state is used to modify the action of the bimetal coil 20, it should be understood to change a liquid to a vapor also could be used. However, the head of fusion makes it easier to confine the material during its changes in state.

Figure 4:
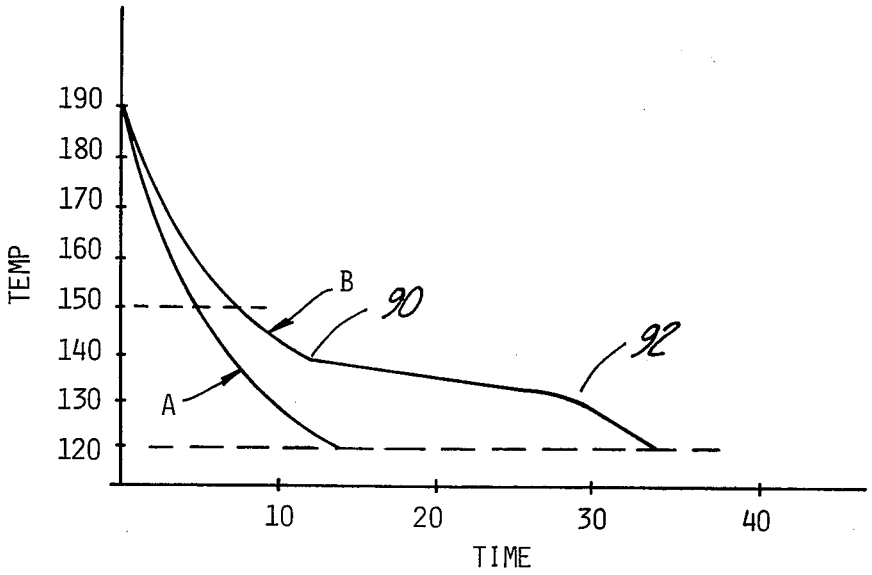
FIG. 4 is a graft showing characteristic curves of the performance of the device.

Referring now to FIG. 4, the significance of the performance of the heat sink 56 in delaying the closing movement of the choke valve 14 is illustrated by typical performance curves in which the abscissa represents time and the ordinate represents temperature. Curve A represents performance of an automatic choke without a heat sink 56 and curve B represents the performance of an automatic choke with the heat sink 56. It will be noted that as temperature begins to decrease both curves A & B depict similar operation until a temperature of 150° is reached. Thereafter the automatic choke represented by curve A continues to cool at a rapid rate whereas the automatic choke 10 represented by curve B requires substantially more time as indicated by portions of curve B between the points 90 and 92. It is during this time that the latent head of fusion stored in the melted paraffin is released to heat the bimetal coil and delay the closing of the choke plate 14. It will be noted from a comparison of curves A and B that the time required to achieve a temperature of 120° is more than twice as long for the automatic choke 10 represented by curve B than for the automatic choke without a heat sink as represented by curve A. This delay in closing time of the choke is very effective in reducing the startup problems of warmed engines and reducing emissions.

The choke control device for carburetors of an internal combustion engine has been provided wherein a bimetal coil regulating the choke is heated electrically to assist the engine in the temperature change as an engine is warming up after it has been started so that the choke is moved to a fully open position at a greater rate than with the engine temperature along and in which heating of the bimetal coil also results in heating of a heat sink which absorbs energy of the engine and heater means after the choke valve has been moved to an open position and which releases the heat back to the bimetal element after the engine has been turned off to delay closing movement of the choke valve.

The embodiments of the invention in which an exclusive property or privilege is claimed are defined as follows:

1. A choke control device for the carburetor of an internal combustion engine having a choke valve, the combination comprising; a bimetal coil having one end adapted to be connected to said choke valve to move said choke valve to a closed position when the temperature of said engine is low and to move said choke valve to a fully open position at a predetermined elevated temperature of said engine, heating means to heat said bimetal coil when said engine is operating, means forming a heat sink disposed in adjacent heat transfer relationship to said bimetal coil, said heat sink including a material operable to absorb latent heat to change the state of said material as a result of said predetermined elevated temperature of said engine after said choke is in said fully open position and operable to return said latent heat to said coil during cooling of said engine to resist cooling of said coil and delay closing of said choke valve.

2. The combination of claim 1 wherein the state of said material when said choke valve is closed is a solid and wherein the state of said material when said choke valve is open is a liquid

3. The combination of claim 1 and further comprising heating means operable to heat said bimetal coil in proportion to engine and ambient temperature.

4. The combination of claim 3 and further comprising a source of electrical power, said heating means comprising a PTC resistor connected to said source of energy.

5. The combination of claim 4 wherein said bimetal coil has its other end connected to a stem fastened to one side of a plate and wherein said PTC unit is connected to said stem.

6. The combination of claim 4 wherein said PTC resistor is mounted on a plate at one side thereof and wherein said bimetal coil is mounted on the other side of said plate.

7. The combination of claim 4 and further comprising a NTC element in series with said PTC element to modulate operation of the latter in accordance with engine temperature.

8. The combination of claim 7 wherein said NTC element is mounted on a plate spaced from said mounting plate and wherein said heat sink is disposed between said plates.

9. The combination of claim 8 wherein said heat sink is disposed between said PTC and NTC elements.

10. The combination of claim 1 wherein said material is operative to absorb latent heat at a temperature above the temperature at which said bimetal coil moves said choke to a fully open position.

11. The combination of claim 10 when said heat sink includes porous retaining means, said material being contained by said retaining means in all of its states.

12. The combination of claim 11 wherein said retaining means is in the form of an absorbent member, said absorbent member being saturated with said material in the form of a paraffin.

13. The combination of claim 12 wherein said heat sink material begins to change state at a temperature above the temperature at which said choke valve begins to move from its open position toward its closed position.

14. The combination of claim 13 wherein said predetermined temperature is greater than but almost equal to said temperature at which said choke valve begins to move from an open position toward a closed position.

* * * * *

UNITED STATES PATENT AND TRADEMARK OFFICE

CERTIFICATE OF CORRECTION

PATENT NO. : 4,218,406

DATED : August 19, 1980

INVENTOR(S) : Charles A. Detweiler

It is certified that error appears in the above—identified patent and that said Letters Patent is hereby corrected as shown below:

Column 2, line 46, "limited about" should read --limited amount-- line 51, "14 beings to" should read --14 begins to--

Column 3, line 18, "PTC element 64" should read --PTC element 54. When the engine or surrounding areas is cold the NTC element 64-- line 19, after "current flow" insert --but as the element 64 begins to get warm there is a reduction-- line 45, "The head sink" should read --The heat sink--

Column 4, line 11, "initialy" should read --initially-- line 20, after "understood" insert --that the latent heat of vaporization, that is the heat required-- line 21, "head" should read --heat-- line 39, "head" should read --heat-- line 55, "along" should read --alone--

Signed and Sealed this

Seventh Day of April 1981

[SEAL]

*Attest:*

RENE D. TEGTMEYER

*Attesting Officer*

*Acting Commissioner of Patents and Trademarks*